US008062248B2

(12) United States Patent
Kindel

(10) Patent No.: US 8,062,248 B2
(45) Date of Patent: Nov. 22, 2011

(54) PILL DISPENSER FOR PETS

(76) Inventor: Charles Edward Kindel, Katy, TX (US)

( * ) Notice: Subject to any disclaimer, the term of this patent is extended or adjusted under 35 U.S.C. 154(b) by 0 days.

(21) Appl. No.: 12/836,311

(22) Filed: Jul. 14, 2010

(65) Prior Publication Data

US 2011/0011884 A1 Jan. 20, 2011

Related U.S. Application Data

(60) Provisional application No. 61/270,791, filed on Jul. 14, 2009.

(51) Int. Cl.
*A61M 31/00* (2006.01)
*A61J 7/00* (2006.01)

(52) U.S. Cl. ..... 604/63; 604/77

(58) Field of Classification Search ..... 604/57–64, 604/77, 225, 514–517; 221/24, 271, 276
See application file for complete search history.

(56) References Cited

U.S. PATENT DOCUMENTS 17,000 A * 4/1857 Somerville ..... 604/59
842,631 A * 1/1907 Deperdussin ..... 604/62
977,004 A * 11/1910 Grimm ..... 604/59
3,494,358 A * 2/1970 Duesterheft et al. ..... 604/137
3,757,781 A 9/1973 Smart
4,060,083 A 11/1977 Hanson
4,174,048 A 11/1979 Volpe, Jr.
4,474,308 A 10/1984 Bergeron
5,681,279 A 10/1997 Roper et al.
6,387,078 B1 * 5/2002 Gillespie, III ..... 604/181
6,960,183 B2 11/2005 Nicolette

* cited by examiner

*Primary Examiner* — Nicholas Lucchesi
*Assistant Examiner* — Nathan R Price
(74) *Attorney, Agent, or Firm* — Dale J. Ream

(57) ABSTRACT

A pill dispenser includes a housing having front, rear, and side walls defining a hollow interior. A pill holding member is removably coupled to the housing front wall and defines a frontward bore configured to receive a pill and being in operative communication with the housing front opening. An elongate plunger shaft having proximal and distal ends is positioned extends through the housing. The shaft is movable between a retracted configuration in which the distal end extends from the housing rear wall and an actuated configuration in which the distal end is adjacent the housing rear wall. A spring is positioned in the dispenser housing and operatively connected to the plunger shaft for selectively moving the plunger shaft between the retracted and actuated configurations so as to eject a pill from the holding member. The shaft may be retracted to selected positions before being spring actuated to dispense a pill.

11 Claims, 4 Drawing Sheets

PILL DISPENSER FOR PETS

CROSS REFERENCE TO RELATED APPLICATION

This non-provisional patent application claims the benefit of provisional application Ser. No. 61/270,791 filed on Jul. 14, 2009, titled Oral Pet Pill Dispenser.

BACKGROUND OF THE INVENTION

This invention relates generally to pill dispensers and, more particularly, to a pill dispenser specifically useful for ejecting a medication in the form of a pill into the mouth of an animal, such as a pet.

A common, yet often undesirable, task of both veterinarians and pet owners is to administer medications to pets. It is particularly difficult to induce a pet, especially a small animal like a cat, to swallow a pill. A pet owner may seek to hide a pill in the animal's normal food; unfortunately, many pets are able to avoid the pill and still ingest most of the food.

Various devices have been proposed in the art for dispensing pills to pets. Although assumably effective for their intended purposes, the existing devices are not configured for single handed administration, do not provide for easy cleaning of the pill receiving chambers, or do not provide for spring-loaded pill ejection in combination with an edible "teaser" member.

Therefore, it would be desirable to have a pill dispenser for efficiently dispensing a pill into the mouth of an animal. Further, it would be desirable to have a pill dispenser that selectively ejects a pill into an animal's mouth when actuated. In addition, it would be desirable to have a pill dispenser that induces a pet to receive the dispenser into its mouth.

SUMMARY OF THE INVENTION

A pill dispenser for dispensing a pill into the mouth of an animal includes a housing having front, rear, and side walls defining a hollow interior, the front and rear walls having openings. A pill holding member is removably coupled to the housing front wall, the pill holding member defining a frontward bore configured to receive a pill and being in operative communication with the dispenser housing front opening. An elongate plunger shaft having proximal and distal ends is positioned along an imaginary longitudinal axis extending through the dispenser housing and the pill holding member. The shaft is movable between a retracted configuration in which the distal end extends outwardly from the housing rear wall and an actuated configuration in which the distal end is adjacent the housing rear wall. A spring is positioned in the dispenser housing and operatively connected to the plunger shaft for selectively moving the plunger shaft between the retracted and actuated configurations so as to eject a pill from the holding member.

Therefore, a general object of this invention is to provide a pill dispenser for use in dispensing a medication in pill form into the mouth of an animal.

Another object of this invention is to provide a pill dispenser, as aforesaid, having a spring loaded shaft that ejects a pill from a pill holding area.

Still another object of this invention is to provide a pill dispenser, as aforesaid, in which the shaft may be cocked to a selected position for accommodating pills of different sizes and regulating an amount of force with which to eject a pill.

Yet another object of this invention is to provide a pill dispenser, as aforesaid, that may be operated with a single hand.

A further object of this invention is to provide a pill dispenser, as aforesaid, having a structure for retaining a food substance so as to induce an animal to receive the dispenser into its mouth.

A still further object of this invention is to provide a pill dispenser, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
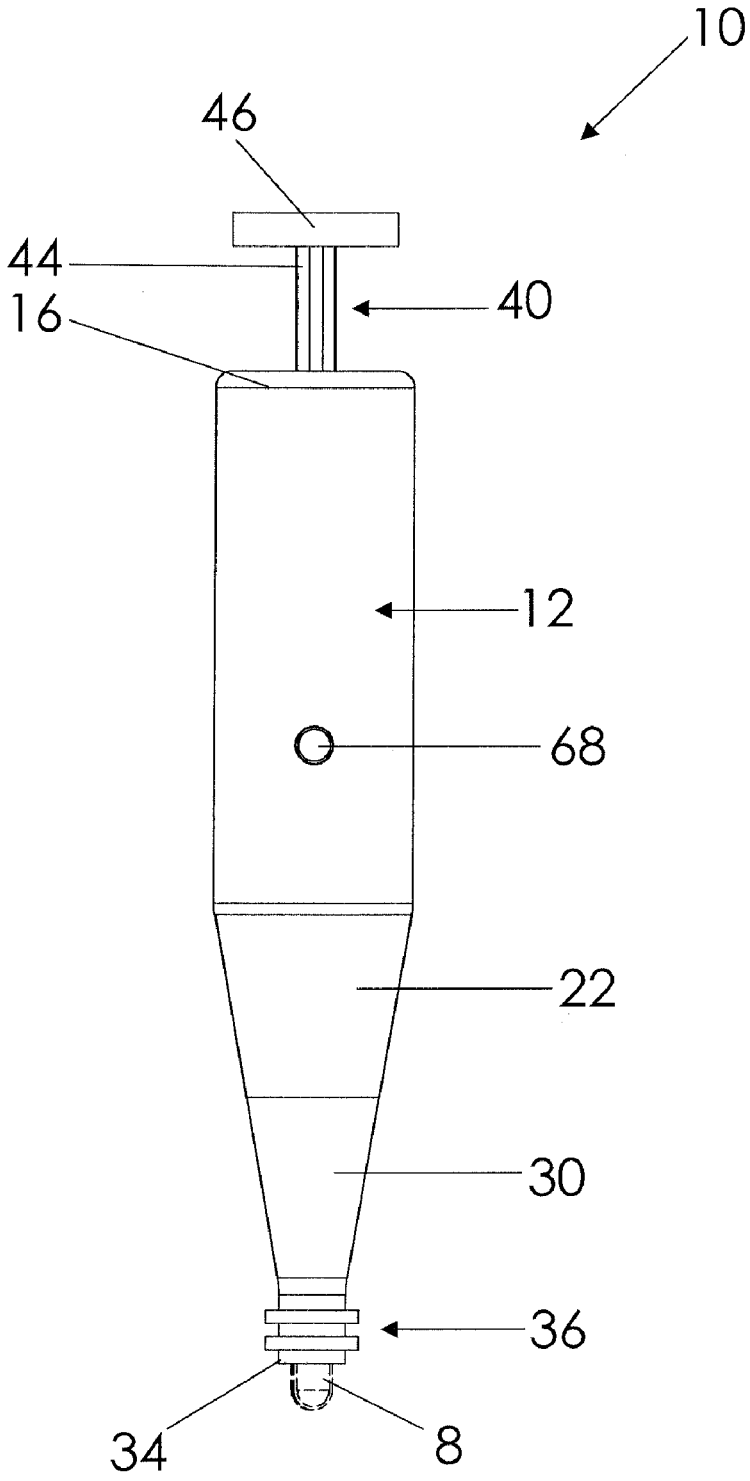
FIG. 1 is a top view of a pill dispenser according to a preferred embodiment of the present invention.

A pill dispenser for dispensing a pill 8 into the mouth of an animal according to a preferred embodiment of the present invention will now be described in detail with reference to FIGS. 1 to 4*c* of the accompanying drawings. The pill dispenser 10 includes a dispenser housing 12, a pill holding member 30, and an actuation assembly 50.

Figure 4A:
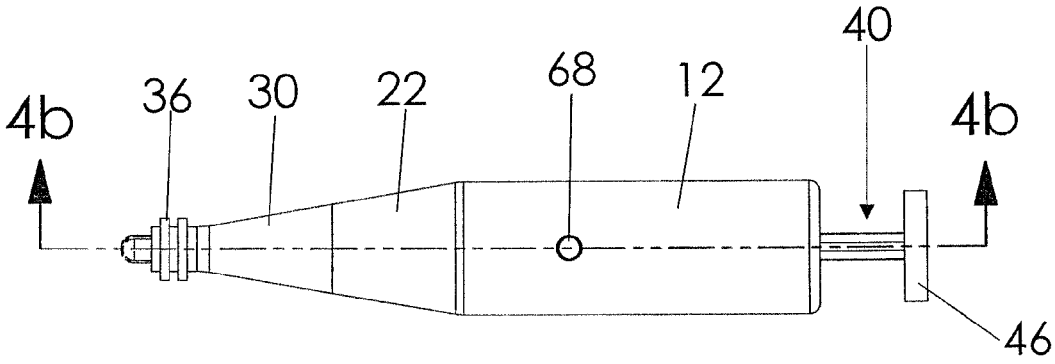
FIG. 4*a* is a top view of the pill dispenser as in FIG. 2*a*.
Figure 4B:
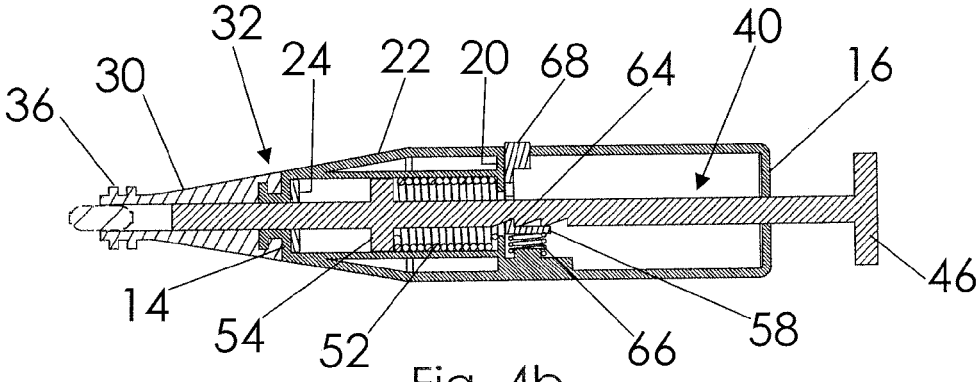
FIG. 4*b* is a sectional view taken along line 4*b*-4*b* of FIG. 4*a* at a retracted configuration.

The dispenser housing 12 includes a front wall 14 and an opposing rear wall 16. Preferably, the dispenser housing 12 includes a generally cylindrical configuration having a continuous side wall 18 extending between the front 14 and rear 16 walls although other configurations would also work. The walls of the dispenser 10 define a generally hollow configuration (FIG. 4*b*). The front 14 and rear 16 walls each define a respective opening as will be described more fully below. An interior wall 20 is situated within the dispenser housing 12 intermediate the front 14 and rear 16 walls and also defines an opening. A bumper pad 24 may be positioned adjacent an inner surface of the housing front wall 14 to absorb impact forces when a plunger shaft is actuated as will be described more fully later.

The pill holding member 30 is removably coupled to the dispenser housing front wall 14. More particularly, the front wall 14 of the dispenser housing 12 and rear edge of the pill holding member 30 may include complementary structures to engage in a removable snap-fit relationship, as indicated at reference numeral 32 of FIG. 4*b*. Alternatively, the dispenser housing 12 and pill holding member 30 may be removably coupled using a threaded arrangement, friction-fit engagement, latches, or the like. The pill holding member 30 is removable from the dispenser housing 12 so that it may be cleaned easily before or after use. Further, the pill holding member 30 defines a frontward bore 34 configured to receive a pill, the bore being configured to communicate with the front wall opening of the dispenser housing 12. It is understood that the pill holding member 30 is removable and may be replaced with another pill holding member having a frontward bore 34 configured for a larger or smaller pill size.

The pill holding member 30 further includes food retaining member 36 that may be useful to induce an animal to receive the dispenser into its mouth. More particularly, the food retaining member 36 may include one or more ribbed or textured surfaces integrally constructed on an outer surface of the pill holding member 30 adjacent the frontward bore 34 (FIG. 1). The food retaining member 36 may be constructed of rubber, plastic, an absorbent pad, or the like. Alternatively, the food retaining member 36 may be removably attached so as to be removed for cleaning purposes. Preferably, the tip of the pill holding member 30 itself is constructed of a flexible and resilient material.

The dispenser housing 12 includes a front portion 22 preferably having a downwardly tapered configuration adjacent said pill holding member 30. Specifically, the front portion 22 is tapered downwardly from the housing 12 to the pill holding member 30. This preferred configuration may provide enhanced grip of the dispenser housing 12 to a user.

Figure 2A:
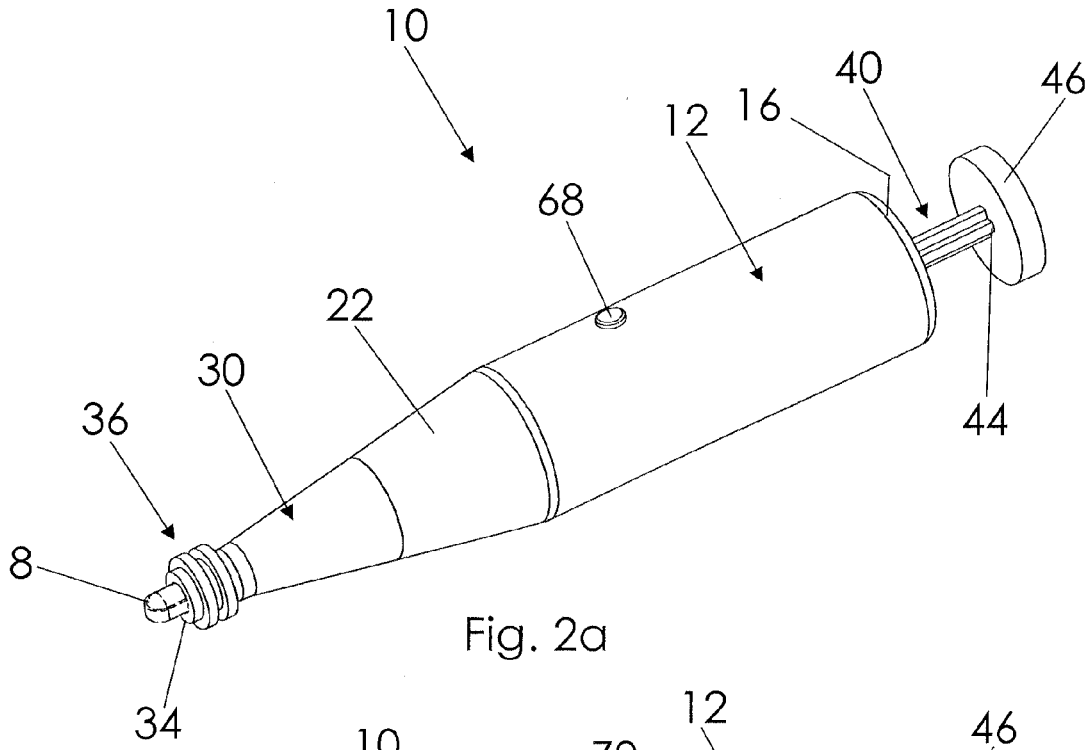
FIG. 2*a* is a perspective view of the pill dispenser as in FIG. 1 shown at a retracted configuration.
Figure 2B:
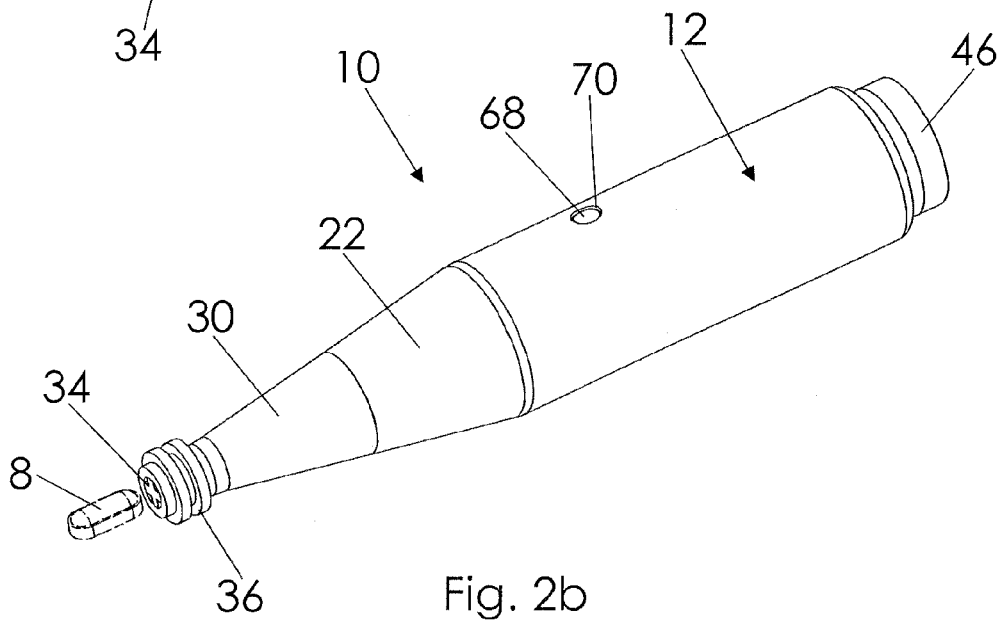
FIG. 2*b* is a perspective view of the pill dispenser as in FIG. 1 shown at an actuated configuration.
Figure 3:
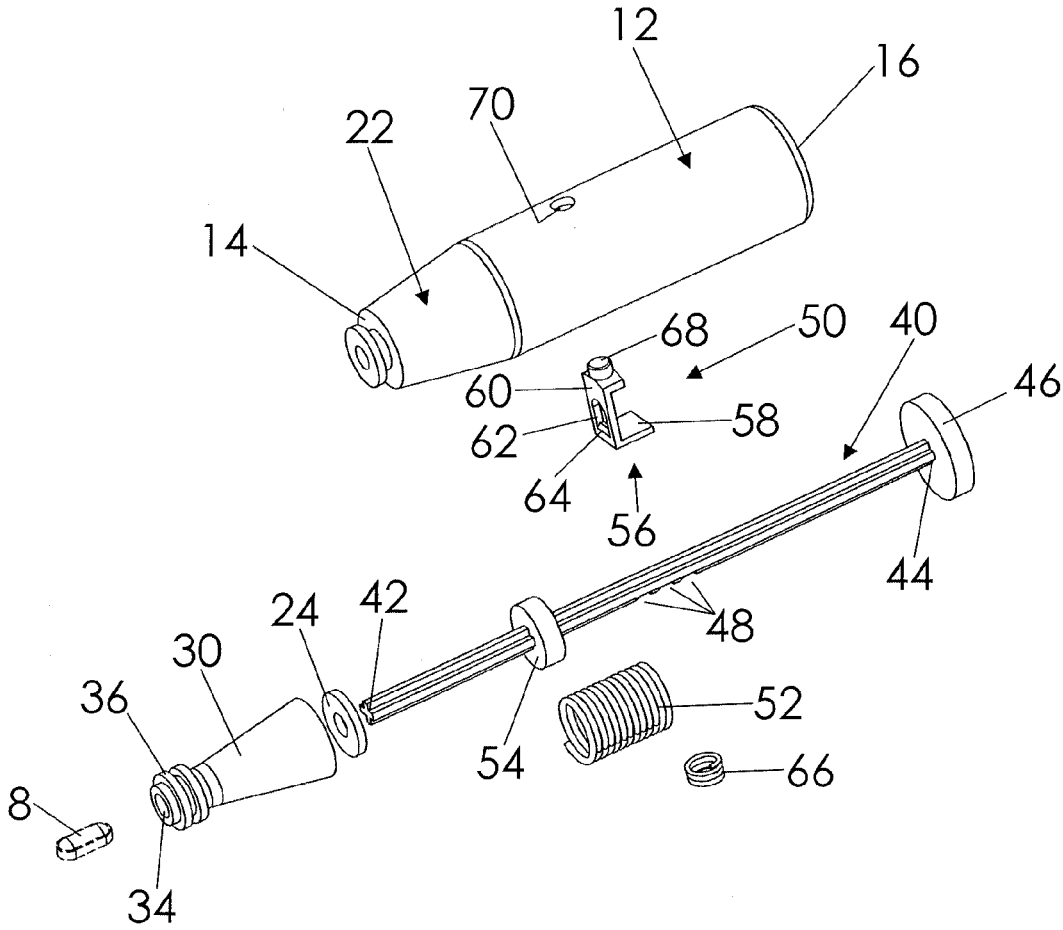
FIG. 3 is an exploded view of the pill dispenser as in FIG. 2*a*.
Figure 4C:
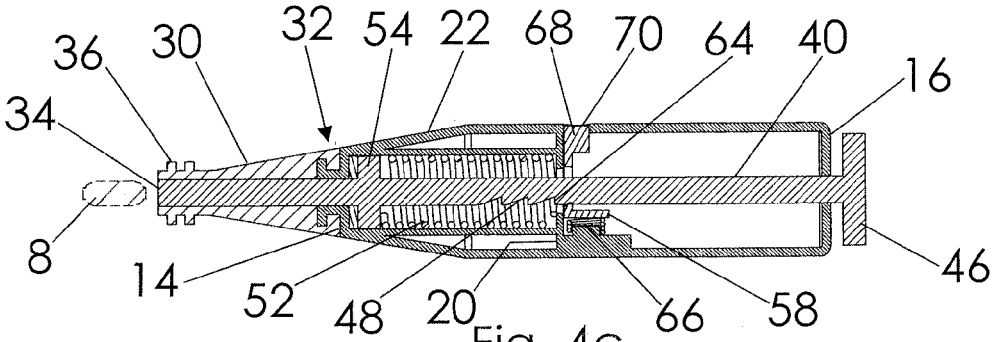
FIG. 4*c* is a sectional view as in FIG. 4*b* at an actuated configuration.

The pill dispenser 10 further includes an elongate plunger shaft 40 having a distal end adjacent said pill holding member and a proximal end opposite said distal end, said proximal and distal ends being positioned within the pill dispenser 10 along an imaginary longitudinal axis that extends through the dispenser housing 12 and pill holding member 30. The plunger shaft 40 is slidably movable therein between a retracted configuration (FIG. 2*a*) in which its proximal end 44 extends outwardly (rearwardly) from the rear wall 16 of the dispenser housing 12 and an actuated configuration (FIG. 2*b*) in which its proximal end 44 is substantially adjacent the dispenser housing rear wall 16. It is understood that the plunger shaft 40 is movable through the front wall, interior, and rear wall openings of the dispenser housing 12 and through the frontward bore 34 of the pill holding member 30 as the plunger shaft 40 is moved between retracted and actuated configurations as best shown in FIGS. 4*b* and 4*c*. The plunger shaft 40 may include a handle end 46 at the proximal end 44 thereof that is generally perpendicular to the plunger shaft 40 so that a user may easily grasp the handle end 46 to pull the shaft 40 toward the retracted configuration (FIG. 2*a*).

The actuation assembly 50 includes a compression spring 52 (also referred to as an ejection spring) that is positioned in the dispenser housing, preferably surrounding the plunger shaft 40 (FIG. 4*b*). A retention wall 54 also extends about the plunger shaft 40 forward of the interior wall 20 of the dispenser housing 12 and the spring 52 is preferably situated therebetween. In other words, the retention wall 54 is positioned intermediate a forward end of the spring and the shaft distal end 42. This configuration enables the plunger shaft 40 to be moved from the retracted configuration (FIG. 4*b*) to the actuated configuration (FIG. 4*c*) when the spring 52 is actuated to an unbiased or extended configuration. In other words, the spring is compressed/biased by the retention wall 54 against the interior wall 20 as the plunger shaft 40 is moved toward the retracted configuration (FIG. 4*b*) and then expands quickly when actuated to the actuated configuration (FIG. 4*c*). The spring 52 may be coupled at one end to the interior wall 20 and at an opposed end to the retention wall 54 although it may be suitable to merely be situated therebetween. When the spring 52 is actuated, the shaft 40 will move forward rapidly and the retention wall 54 may contact the housing front wall 14, although the bumper 24 situated at the front wall 14 is designed to absorb those impact forces so as not to unduly frighten the animal in whose mouth the dispenser housing 12 is inserted.

The actuation assembly 50 includes means for selectively holding the spring 52 and plunger shaft 40 at the retracted configuration (FIG. 4*b*) until a user manually actuates the spring 52 to move the plunger shaft 40 to the actuated configuration (FIG. 4*c*). First, the plunger shaft 40 may define a series of notches 48 spaced apart along the longitudinal axis. Further, the actuation assembly 50 includes an actuator 56 mounted in the dispenser housing 12 having a base member 58, a support member 60 extending upwardly from the base member 58 that defines an aperture 62 configured such that the plunger shaft 40 may extend therethrough. A stop 64, such as a nub or lip, is integrally constructed or attached adjacent the actuator aperture 62 and includes a configuration complementary to that of the shaft notches 48 described above so as to be selectively received in a respective notch 48. When received therein, the plunger shaft 40 is prevented from normal sliding movement and held in the retracted configuration. Still further, an actuator spring 66 is positioned under the base member 58 in operative contact therewith. An actuator button 68 extends upwardly from the support member 60. In operation, when the button 68 is depressed, the support member 60 and base member 58 are urged downwardly to compress the actuator spring 66, causing the stop 64 to be displaced from a respective notch 48 and allowing the shaft 40 to move to the actuated configuration (FIG. 4*c*) by operation of spring 52. In addition, the dispenser housing 12 defines a hole 70 through which the button 68 may extend when the stop 64 is nested in a respective notch 48 in that the actuator spring 66 urges the entire actuator 56 upwardly (FIG. 4*b*).

In use, a user such as a pet owner may insert a pill 8 into the frontward bore 34 of the pill holding member 30 and then slide the plunger shaft 40 to a desired retracted position by pulling on the handle end 46 of the plunger shaft 40 (FIG. 4*b*). The actuator button 68 may be depressed while the shaft 40 is retracted to a desired position and then released to extend through the dispenser housing hole (FIG. 2*a*), at which point the stop 64 engages a respective plunger shaft notch 48. If needed, a food substance such as honey or the like may be smeared onto the retaining member 36 of the pill holding member 30 so as to induce the pet to accept the holding member 3 into his mouth. Then, a user may depress the actuator button 68 to allow the spring 52 to cause the plunger shaft 40 to eject the pill 8 from the pill holding member 30 into the pet's mouth as described above.

This invention also contemplates that the plunger shaft 40 may be operated without inclusion or operation of a spring 52 to actuate pill delivery. In other words, the plunger may simply be retracted to a desired distance and then slid forward manually by a user once the pill holding member has been positioned within the mouth of the animal. In this embodiment, the shaft 40 may or may not include the actuation assembly 50 to hold the shaft 40 at a selected position until the button 68 is depressed to allow shaft movement.

It is understood that while certain forms of this invention have been illustrated and described, it is not limited thereto except insofar as such limitations are included in the following claims and allowable functional equivalents thereof.

What is claimed is:

1. A pill dispenser for dispensing a pill into the mouth of an animal, comprising:

a dispenser housing having a front wall, a rear wall, and a continuous side wall extending between said front and rear walls, said front and rear walls defining front and rear openings, respectively, and said dispenser housing defining a generally hollow configuration;

a pill holding member removably coupled to said housing front wall, said pill holding member defining a frontward bore configured to receive a pill and being in operative communication with said dispenser housing front opening;

wherein said pill holding member includes an outer surface having at least one of a ribbed or textured surface configured to retain a food substance to induce an animal to receive said pill holding member into its mouth;

an elongate plunger shaft having a distal end adjacent said pill holding member and a proximal end opposite said distal end, said proximal and distal ends being positioned along an imaginary longitudinal axis extending through said dispenser housing and said pill holding member, said plunger shaft being movable between a retracted configuration in which said proximal end extends outwardly from said dispenser housing rear wall and an actuated configuration in which said proximal end is substantially adjacent said dispenser housing rear wall;

wherein said pill holding member is completely emptied when said plunger shaft is at said actuated configuration;

wherein said plunger shaft defines a plurality of notches spaced apart along said imaginary longitudinal axis;

a spring positioned in said dispenser housing and operatively connected to said plunger shaft for selectively moving said plunger shaft between said retracted and actuated configurations such that the pill is ejected from said holding member frontward bore;

wherein:

said spring is positioned to surround said plunger shaft and oriented inline therewith;

a retention wall extends about said plunger shaft intermediate a forward end of said spring and said plunger shaft distal end, wherein said retention wall compresses said spring at said retracted configuration;

an actuator mounted in said dispenser housing, comprising:

a base member;

a support member extending upwardly from said base member, said support member defining an aperture configured so that said plunger shaft extends therethrough;

a stop situated adjacent said aperture and configured to be received in a selected plunger shaft notch, whereby to prevent movement of said plunger shaft through said aperture;

an actuator spring positioned in operative contact beneath said base member; and a button mounted atop said support member and configured such that a manual force upon said button causes said base member to compress said actuator spring and move said stop out of a respective notch, to cause said plunger shaft to move through said aperture and to said actuated configuration.

2. The pill dispenser as in claim 1, further comprising a bumper pad mounted within said dispenser housing adjacent said front opening so as to absorb impact forces imparted by said retention wall when said plunger shaft moves from said retracted configuration to said actuated configuration.

3. The pill dispenser as in claim 1, wherein said side wall of said plunger housing defines a hole through which said actuator button extends when said plunger shaft is at a selected retracted configuration, said actuator button being biased to extend therethrough by said actuator spring.

4. The pill dispenser as in claim 1, wherein said proximal end of said plunger shaft includes a handle end perpendicular to said plunger shaft that may be grasped by a user's hand.

5. The pill dispenser as in claim 1, wherein said proximal end of said plunger shaft includes a handle end perpendicular to said plunger shaft that may be grasped by a user's hand.

6. The pill dispenser as in claim 1, wherein said dispenser housing includes a front portion having a downwardly tapered configuration adjacent said pill holding member.

7. The pill dispenser as in claim 6, wherein said spring is positioned in said front portion of said dispenser housing.

8. The pill dispenser as in claim 7, wherein said pill holding member is coupled to said dispenser housing in a snap-fit relationship.

9. The pill dispenser as in claim 7, wherein said pill holding member is threadably coupled to said dispenser housing.

10. The pill dispenser as in claim 1, wherein said dispenser housing includes an interior wall intermediate said front and rear dispenser housing walls, said spring being coupled at one end to said interior wall and at an opposed end to said plunger shaft retention wall such that said spring is movable between compressed and extended configurations upon movement of said plunger shaft between said retracted and actuated configurations.

11. The pill dispenser as in claim 1, further comprising another pill holding member removably and selectively coupled to said housing front wall when said pill holding member is selectively removed therefrom, said another pill holding member defining a frontward bore configured to receive a pill and being in operative communication with said dispenser housing front opening, said frontward opening of said another pill holding member having a size different than a size of said frontward opening of said pill holding member.

* * * * *